US008799002B1

(12) United States Patent
Tang et al.

(10) Patent No.: US 8,799,002 B1
(45) **Date of Patent: *Aug. 5, 2014**

(54) EFFICIENT SCALEFACTOR ESTIMATION IN ADVANCED AUDIO CODING AND MP3 ENCODER

(71) Applicant: Marvell International Ltd., Hamilton (BM)

(72) Inventors: Lijie Tang, Shanghai (CN); Ke Ding, Shanghai (CN); Zhengyuan Quan, Shanghai (CN)

(73) Assignee: Marvell International Ltd., Hamilton (BM)

( * ) Notice: Subject to any disclaimer, the term of this patent is extended or adjusted under 35 U.S.C. 154(b) by 0 days.

This patent is subject to a terminal disclaimer.

(21) Appl. No.: 14/029,240

(22) Filed: Sep. 17, 2013

Related U.S. Application Data

(63) Continuation of application No. 12/626,161, filed on Nov. 25, 2009, now Pat. No. 8,548,816.

(60) Provisional application No. 61/118,811, filed on Dec. 1, 2008.

(51) Int. Cl.
*G10L 19/00* (2013.01)

(52) U.S. Cl.
USPC ..... 704/500

(58) Field of Classification Search
USPC ..... 704/200.1, 222, 230, 500–504
See application file for complete search history.

(56) References Cited

U.S. PATENT DOCUMENTS

| | | | | |
|---|---|---|---|---|
| 6,484,137 | B1 * | 11/2002 | Taniguchi et al. | 704/211 |
| 6,934,677 | B2 | 8/2005 | Chen et al. | |
| 6,950,794 | B1 | 9/2005 | Subramaniam et al. | |
| 8,356,547 | B2 * | 1/2013 | Gray, Jr. | 91/506 |
| 8,548,816 | B1 * | 10/2013 | Tang et al. | 704/500 |
| 2003/0115051 | A1 | 6/2003 | Chen et al. | |
| 2004/0078205 | A1 * | 4/2004 | Liljeryd et al. | 704/503 |
| 2005/0075871 | A1 | 4/2005 | Youn | |
| 2005/0075888 | A1 | 4/2005 | Young et al. | |
| 2008/0027709 | A1 * | 1/2008 | Baumgarte | 704/200.1 |
| 2008/0243518 | A1 | 10/2008 | Oraevsky et al. | |

* cited by examiner

*Primary Examiner* — Abul Azad

(57) ABSTRACT

An efficient approach for estimating scalefactors for use in the quantization of audio signal spectrum values is described. The scalefactor estimation approach can be implemented in multiple stages. A first stage estimates a distortion level for a selected scalefactor band spectrum value based on a received maximum tolerant distortion threshold and the spectrum values in the scalefactor band. A second stage determines an interim process value based on the previously estimated distortion level and generates a scalefactor for a selected scalefactor band spectrum value based on the generated interim process value and a statistically predetermined fraction. A third stage generates a scalefactor that applies to the whole scalefactor band based on the scalefactor generated for the selected scalefactor band spectrum value. The approach provides a performance gain of 40% over previous techniques, thereby reducing device power requirements and audio encoder bottlenecks.

20 Claims, 9 Drawing Sheets

EFFICIENT SCALEFACTOR ESTIMATION IN ADVANCED AUDIO CODING AND MP3 ENCODER

INCORPORATION BY REFERENCE

This application is a continuation of U.S. application Ser. No. 12/626,161, filed on Nov. 25, 2009, now issued as U.S. Pat. No. 8,548,816, which claims priority under 35 U.S.C. §119(e) to U.S. Provisional Application No. 61/118,811, filed on Dec. 1, 2008. The disclosures of the applications referenced above are incorporated herein by reference in their entireties.

BACKGROUND

Adaptive quantization is used by frequency-domain audio encoders, such as the advance audio coding (AAC) and MP3 encoder, to reduce the number of bits required to store encoded audio data, while maintaining a desired audio quality.

Adaptive quantization transforms time-domain digital audio signals into frequency-domain signals and groups the respective frequency-domain spectrum data into frequency bands, or scalefactor bands. In this manner, the techniques used to eliminate redundant data, i.e., inaudible data, and the techniques used to efficiently quantize and encode the remaining data, can be tailored based on the frequency and/or other characteristics associated with the respective scalefactor bands, such as the perception of the frequencies in the respective scalefactor bands by the human ear.

For example, in advance audio coding, the interval, or scalefactor, used to quantize each respective scalefactor band can be individually determined for each scalefactor band. Selection of a scalefactor for each scalefactor band allows the advance audio coding process to use scalefactors to quantize the signal in certain spectral regions (the scalefactor bands) to leverage the compression ratio and the signal-to-noise ratio in those bands. Thus scalefactors implicitly modify the bit-allocation over frequency since higher spectral values usually need more bits to be encoded. The use of larger scalefactors reduces the number of bits required to encode a scalefactor band, however, the use of larger scalefactors introduces an increase amount of distortion to the encoded signal. The use of smaller scalefactors decreases the amount of distortion introduced to the final encoded signal, however, the use of smaller scalefactors also increases the number of bits required to encode a scalefactor band.

In order to achieve improved sound quality as well as improved compression, selection of an appropriate scalefactor for each scalefactor band is an important process. Unfortunately, current approaches for selecting a scalefactor for a scalefactor band are computationally complex and processor cycle intensive.

The background description provided herein is for the purpose of generally presenting the context of the disclosure. Work of the presently named inventors, to the extent the work is described in this background section, as well as aspects of the description that may not otherwise qualify as prior art at the time of filing, are neither expressly nor impliedly admitted as prior art against the present disclosure.

SUMMARY

An efficient approach for estimating scalefactors for use in the quantization of audio signal spectrum data is described. The scalefactor estimation approach can be implemented in multiple stages. A first stage estimates a distortion level for a selected scalefactor band spectrum value based on a received maximum tolerant distortion threshold and the spectrum values in the scalefactor band. A second stage determines an interim process value based on the previously estimated distortion level and generates a scalefactor for a selected scalefactor band spectrum value based on the generated interim process value and a statistically predetermined fraction. A third stage generates a scalefactor that applies to the whole scalefactor band based on the scalefactor generated for the selected scalefactor band spectrum value. The approach provides a performance gain of 40% over previous techniques, thereby reducing device power requirements and audio encoder bottlenecks.

In one example embodiment, an audio encoder is described that includes a scalefactor estimation module that includes, a difference generating module that can determine a distortion level, for a spectrum value selected from a set of spectrum values in a scalefactor band, based on a maximum tolerant distortion threshold for the scalefactor band, and the set of spectrum values within the scalefactor band, a spectrum value scalefactor generating module that can generate a scalefactor for the selected spectrum value based in part on the determined distortion level and the selected spectrum value, and a spectrum band scalefactor generating module that can generate a scalefactor for the scalefactor band based on the scalefactor generated for the selected spectrum value.

In a second example embodiment, a method of generating a scalefactor for a scalefactor band is described that includes, generating a distortion level for a spectrum value selected from a set of spectrum values in the scalefactor band, based on a maximum tolerant distortion threshold for the scalefactor band and the set of spectrum values within the scalefactor band, generating a scalefactor for the selected spectrum value based in part on the distortion level and the selected spectrum value, and generating the scalefactor for the scalefactor band based on the scalefactor generated for the selected spectrum value.

In a third example embodiment, an audio encoder is described that generates a scalefactor for a scalefactor band using a method that includes, generating a distortion level for a spectrum value selected from a set of spectrum values in the scalefactor band, based on a maximum tolerant distortion threshold for the scalefactor band and the set of spectrum values within the scalefactor band, generating a scalefactor for the selected spectrum value based in part on the distortion level and the selected spectrum value, and generating the scalefactor for the scalefactor band based on the scalefactor generated for the selected spectrum value.

BRIEF DESCRIPTION OF THE DRAWINGS

Example embodiments of an efficient approach for estimating scalefactors for use in the quantization of audio signal spectrum data will be described with reference to the following drawings, wherein like numerals designate like elements, and wherein.

DETAILED DESCRIPTION OF EMBODIMENTS

Figure 1:
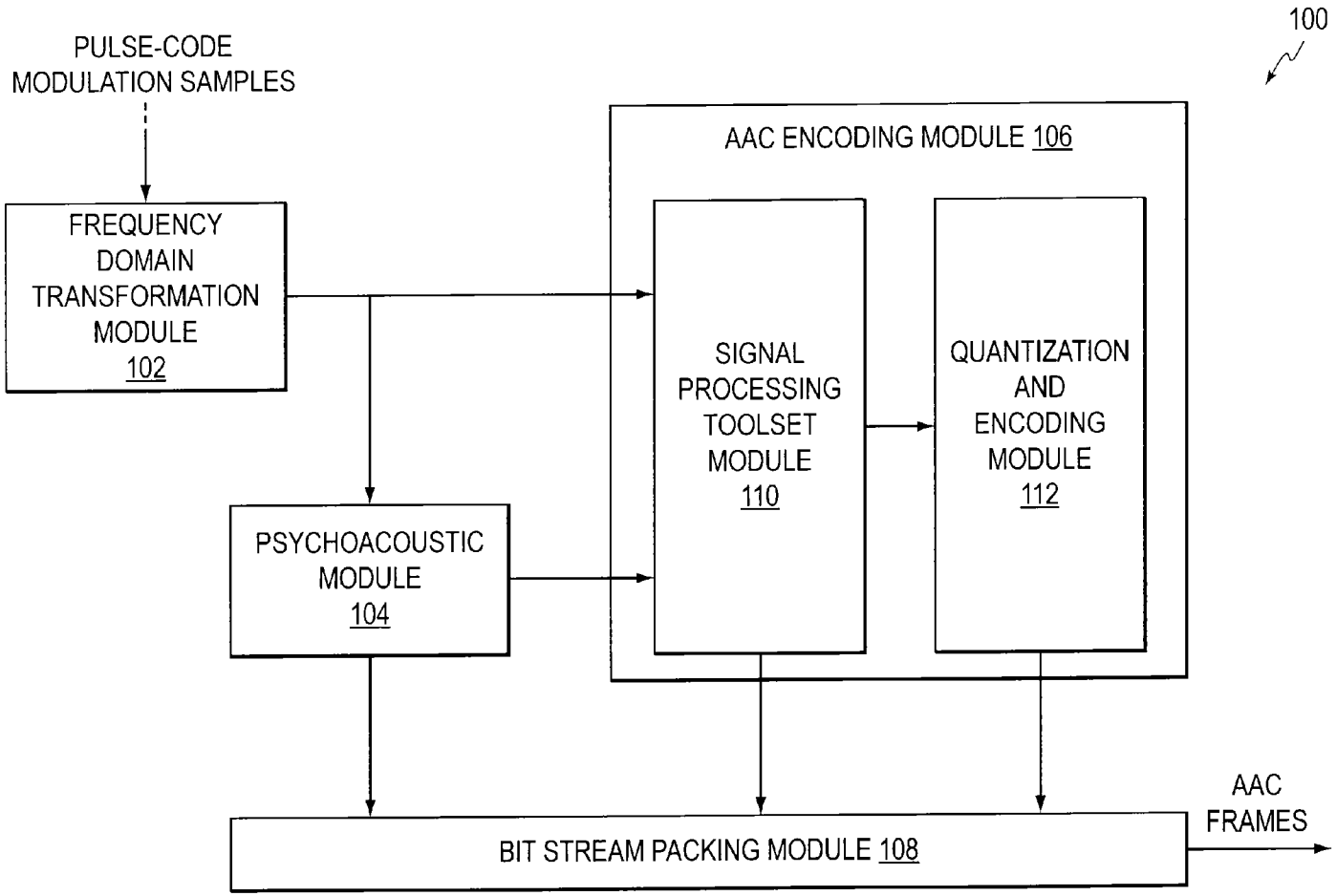
FIG. 1 is a block diagram of an example audio signal encoder architecture that includes example embodiments of the described scalefactor estimation approach.

FIG. 1 is a block diagram of an example audio signal encoder architecture that includes example embodiments of the described scalefactor estimation approach. As shown in FIG. 1, audio signal encoder 100 can include a frequency domain transformation module 102, a psychoacoustic module 104, an advanced audio coding encoding module 106, and a bitstream packing module 108. As further shown in FIG. 1, AAC encoding module 106 can include a signal processing toolset module 110 and a quantization and encoding module 112.

In operation, frequency domain transformation module 102 receives digital, time-domain based, audio signal samples, e.g., pulse-code modulation (PCM) samples, and performs a time-domain to frequency domain transformation, e.g., a Modified Discrete Cosine Transform (MDCT), that results in digital, frequency-based audio signal samples, or audio signal spectrum values, or spectrum values. Frequency domain transformation module 102 arranges these spectrum values into frequency bands, or scalefactor bands, that roughly reflect the Bark scale of the human auditory system. For example, the Bark scale defines 24 critical bands of hearing with frequency band edges located at 20 Hz, 100 Hz, 200 Hz, 300 Hz, 400 Hz, 510 Hz, 630 Hz, 770 Hz, 920 Hz, 1080 Hz, 1270 Hz, 1480 Hz, 1720 Hz, 2000 Hz, 2320 Hz, 2700 Hz, 3150 Hz, 3700 Hz, 4400 Hz, 5300 Hz, 6400 Hz, 7700 Hz, 9500 Hz, 12000 Hz, 15500 Hz. Frequency domain transformation module 102 can group the generated spectrum values in scalefactor bands with similar frequency band edges.

Psychoacoustic module 104 receives spectrum values from the frequency domain transformation module 102, e.g., grouped in scalefactor bands, and processes the respective scalefactor bands based on a psychoacoustic model of human hearing. For example, psychoacoustic module 104 can assess the intensity of the spectrum values within the respective scalefactor bands to determine a maximum level of distortion, or maximum tolerant distortion threshold, that can be introduced to the spectrum values in a scalefactor band by the quantization process without significantly degrading the sound quality of the quantized audio signal. As described below, the maximum tolerant distortion threshold produced by psychoacoustic module 104 for each scalefactor band is used by quantization and encoding module 112 as a control parameter to control aspects of the quantization and encoding process. Further, psychoacoustic module 104 can process the received spectrum values and can remove, e.g., set to 0, spectrum values from the respective scalefactor bands with frequencies and intensities known, based on the psychoacoustic model of human hearing, to be inaudible to the human ear. Such an approach allows psychoacoustic module 104 to improve the data compression that can be achieved by subsequent spectrum values processing, quantization and encoding processes without significantly impacting the quality of the audio signal.

Signal processing toolset module 110 receives scalefactor band spectrum values from frequency domain transformation module 102 and receives a maximum tolerant distortion threshold from psychoacoustic module 104 for each received set of scalefactor band spectrum values and provides additional tools that can be used to further process scalefactor band spectrum values to further increase compression efficiency. For example, signal processing toolset module 110 may be configured with tools such as mid-side stereo coding, temporal noise shaping, perceptual noise substitution, and others, that may be combined to produce different encoding profiles based, for example, on the nature and/or characteristics of the received audio signal and a desired audio quality and desired final compression size. For example, in one example embodiment, the signal processing toolset module 110 is configured with a low complexity (LC) toolset, resulting in audio signal encoder 100 being configured as an advanced audio coding low complexity (AAC LC) audio signal encoder. However, however, signal processing toolset module 110 may be statically or dynamically configured with other signal processing profiles. Such profiles may include additional signal processing tools and/or control parameters to support additional and/or different processing than that supported by the low complexity (LC) toolset.

Quantization and encoding module 112 quantizes and encodes received scalefactor band spectrum values based on the maximum tolerant distortion threshold associated with the scalefactor band. Quantization and encoding module 112 can receive scalefactor band spectrum values and maximum tolerant distortion thresholds either directly from frequency domain transformation module 102 and psychoacoustic module 104, respectively, or can receive scalefactor band spectrum values and maximum tolerant distortion thresholds from signal processing toolset module 110 that have been further processed and modified by one or more signal processing toolsets, as described above. Details related to quantization and encoding module 112 are described in greater detail below with respect to FIG. 2 and FIG. 3. For example, as described below with respect to FIG. 4, the quantization and encoding process performed by quantization and encoding module 112 may be performed under the control of a double control processing loop until the resulting encoded data meets the maximum tolerant distortion threshold and target compression size set for the scalefactor band.

Bitstream packing module 108 receives control parameters from psychoacoustic module 104 and signal processing toolset module 110 and receives control parameters and encoded data from quantization and encoding module 112 and packs the encoded data, scalefactor bands scalefactors and/or other header/control data within AAC compatible frames. For example, the control parameters and encoded data received from psychoacoustic module 104, signal processing toolset module 110 and quantization and encoding module 112 may be processed to form a set of predefined syntax elements that are included within each AAC frame. Details related to an example AAC frame format is addressed in detail in ISO/IEC 14496-3:2005 (MPEG-4 Audio).

Figure 2:
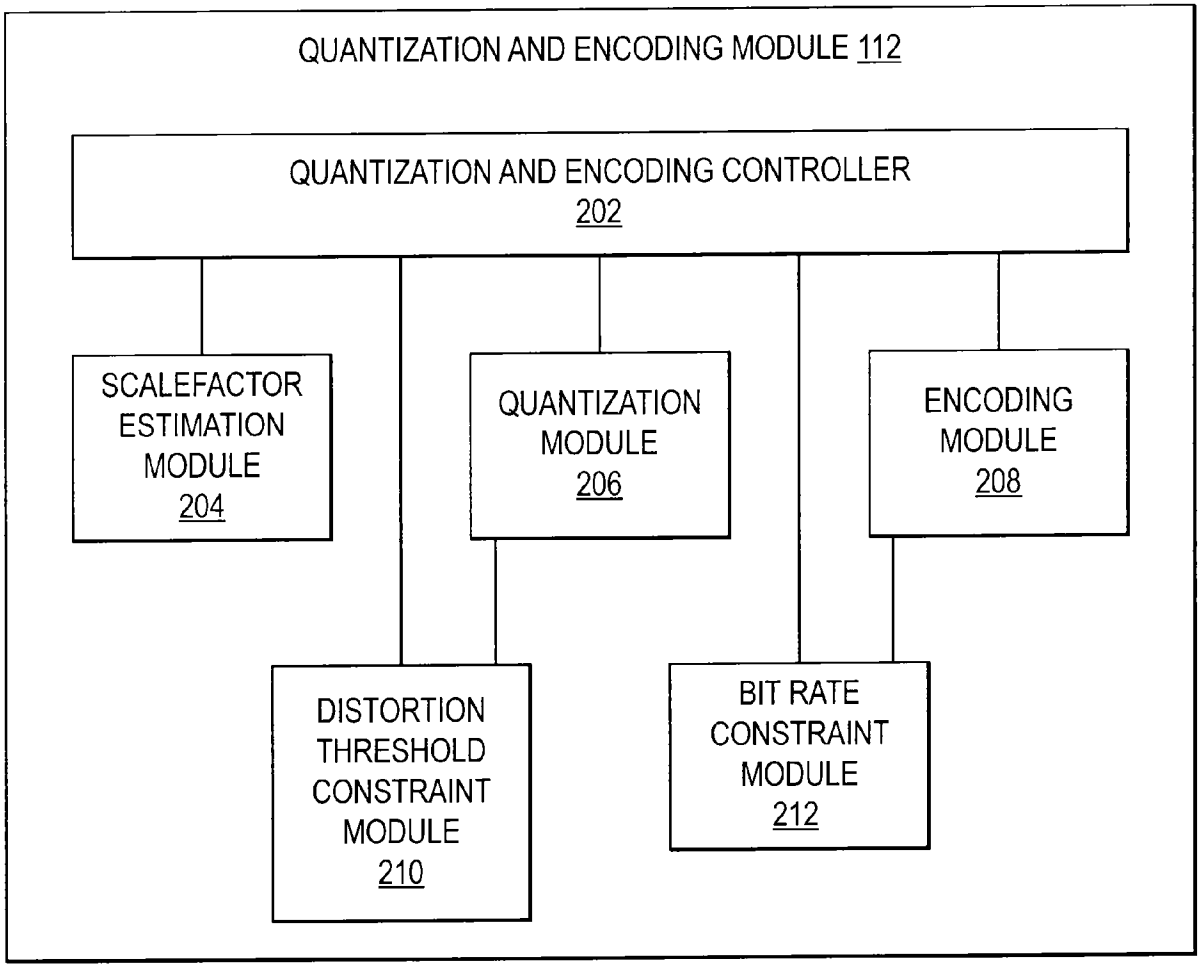
FIG. 2 is an embodiment of a quantization and encoding module shown in FIG. 1 that includes example embodiments of the described scalefactor estimation approach.

FIG. 2 is one embodiment of quantization and encoding module 112 described above with respect to FIG. 1. As shown in FIG. 2, quantization and encoding module 112 can include a quantization and encoding controller 202, a scalefactor estimation module 204, a quantization module 206, an encoding module 208, a distortion threshold constraint module 210 and a bit rate constraint module 212. As described above with respect to FIG. 1, quantization and encoding module 112 quantizes and encodes received scalefactor band spectrum values based on the maximum tolerant distortion threshold associated with the scalefactor band. Details related to operation of quantization and encoding module 112 operating under the control of quantization and encoding controller 202 are described below with respect to FIG. 4 and FIG. 5.

In operation, quantization and encoding controller 202 maintains a set of static and/or dynamically updated control parameters that can be used by quantization and encoding controller 202 to invoke the other modules included in quantization and encoding module 112 to perform operations. Examples of such operations, performed in accordance with the control parameters and a set of predetermined process flows, are described below with respect to FIG. 4 and FIG. 5. Quantization and encoding controller 202 may communicate with and receive status updates from the respective modules within quantization and encoding module 112 to allow quantization and encoding controller 202 to control operation of the respective process flows.

Scalefactor estimation module 204 can be invoked by quantization and encoding controller 202 to estimate a scalefactor for use in quantizing a received set of scalefactor band spectrum values. The process used by scalefactor estimation module 204 to estimate a scalefactor is described in greater detail at least with respect to FIG. 5. As described, scalefactor estimation module 204 is able to efficiently estimate a scalefactor based on a received set of scalefactor band spectrum values and the received scalefactor band maximum tolerant distortion threshold. Quantization is the most performance consuming part in an AAC encoder. Since an AAC encoder uses loss quantization, the quantization increment, i.e., the scalefactor, is crucial to the overall encoding quality. The scalefactor estimation process used by scalefactor estimation module 204 is applied at the scalefactor band level. Therefore the scalefactor estimation process used by scalefactor estimation module 204 is applied multiple times for each channel per frame. As described below, the scalefactor estimation process used by scalefactor estimation module 204 results in approximately a 40% performance improvement over other scalefactor estimation algorithms and yet is capable of consistently producing quantized scalefactor band values with a noise level within the tolerance prescribed by the scalefactor band maximum tolerant distortion threshold associated with the respective scalefactor band values.

Quantization module 206 can be invoked by quantization and encoding controller 202 to perform adaptive quantization of scalefactor band spectrum values. Quantization module 206 uses the scalefactor generated by scalefactor estimation module 204 to quantize the received scalefactor band spectrum values in a manner consistent with the maximum tolerant distortion threshold assigned to the scalefactor band. By quantizing each scalefactor band based on a scalefactor specifically selected based on the spectrum values within the scalefactor band and a maximum tolerant distortion threshold selected for the scalefactor band based on an analysis of the spectrum values within the scalefactor band with a psychoacoustic model of human hearing, quantization module 206 is able to tailor the quantization process for each scalefactor band resulting in efficient compression and optimized audio quality at any specified bit rate.

Encoding module 208 can be invoked by quantization and encoding controller 202 to apply a predetermined coding scheme to quantized scalefactor band spectrum values to produce encoded scalefactor data.

Distortion threshold constrain module 210 can be invoked by quantization and encoding controller 202 to validate whether quantized data produced by quantization module 206 complies with the maximum tolerant distortion threshold imposed by either an external control parameter that reflects an end-user requirement, the psychoacoustic module 104, or one or more of the signal processing tools included in the encoding profile implemented by signal processing toolset module 110. If the maximum tolerant distortion threshold is not met, e.g., as described below, additional signal processing by tools within signal processing toolset module 110 may be performed and the quantization process for the set of scalefactor spectrum values is repeated using adjusted control parameters, such as an adjusted global scalefactor, an adjusted maximum tolerant distortion threshold and/or a new estimated scalefactor.

Bit rate constraint module 212 can be invoked by quantization and encoding controller 202 to validate whether encoded data produced by encoding module 208 complies with a bit constraint imposed by either an external control parameter that reflects an end-user requirement, or a bit constraint imposed by one or more of the signal processing tools included in the encoding profile implemented by signal processing toolset module 110. If a bit constraint is not met, e.g., as described below, additional signal processing by tools within signal processing toolset module 110 may be performed and the quantization process and the encoding process for the set of scalefactor spectrum values is repeated using adjusted control parameters, such as an adjusted global scalefactor, an adjusted maximum tolerant distortion threshold and/or a new estimated scalefactor.

Figure 3:
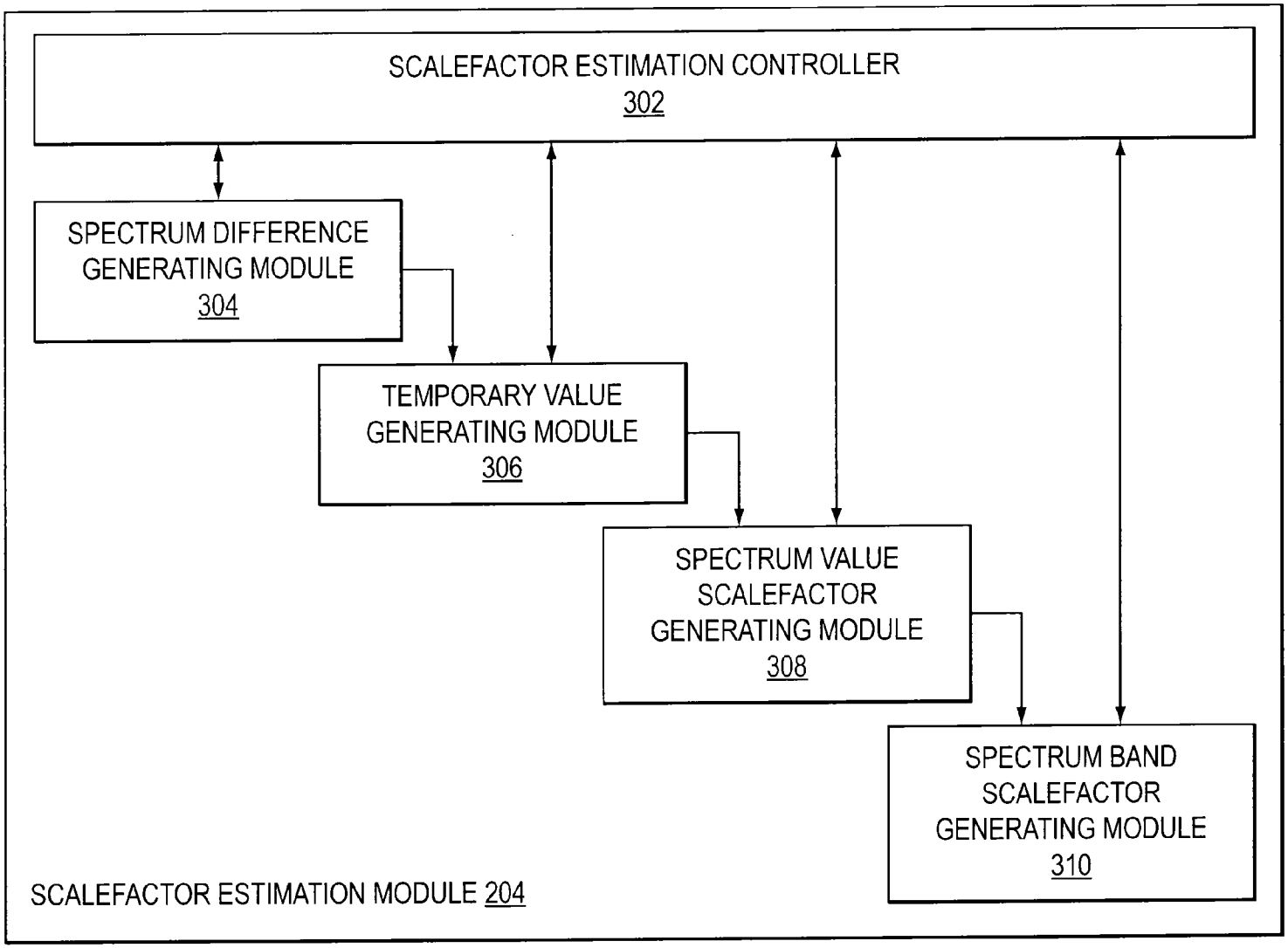
FIG. 3 is an embodiment of a scalefactor estimation module shown in FIG. 2 that includes example embodiments of the described scalefactor estimation approach.

FIG. 3 is one embodiment of the scalefactor estimation module 204 shown in FIG. 2. The scalefactor estimation module 204 is used to implement embodiments of the described scalefactor estimation approach, detail of which are described below with respect to equation [1] through equation [4] and with respect to FIG. 4 and FIG. 5. As shown in FIG. 3, scalefactor estimation module 204 can include a scalefactor estimation controller 302, a spectrum difference generating module 304, a temporary value generating module 306, a spectrum value scalefactor generating module 308, and a spectrum band scalefactor generating module 310.

Figure 5:
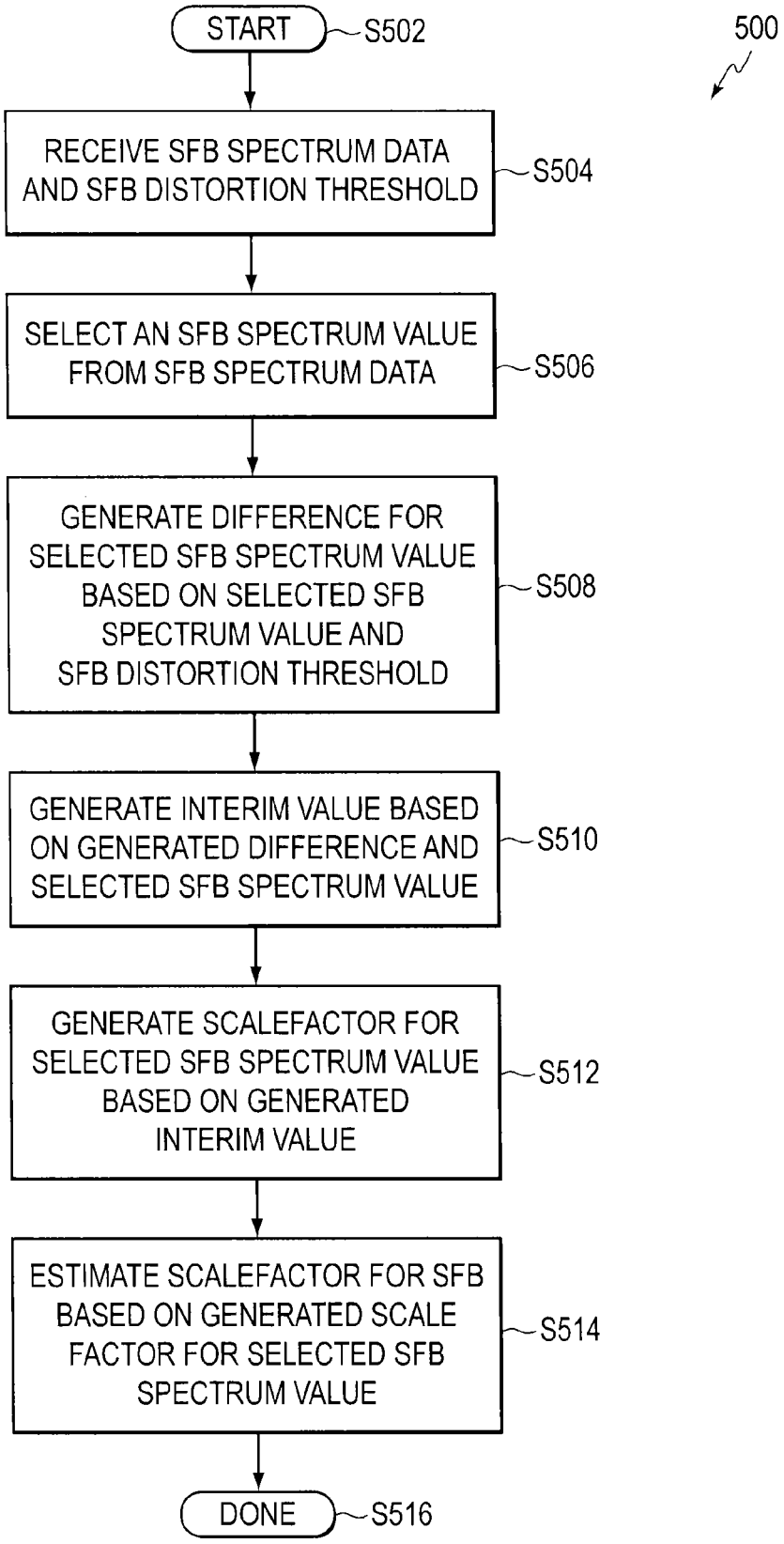
FIG. 5 is a flow-chart of a process that uses an example embodiment of the described scalefactor estimation approach.

In operation, scalefactor estimation controller 302 maintains a set of static and/or dynamically updated control parameters that can be used by scalefactor estimation controller 302 to invoke the other modules included in scalefactor estimation module 204 to perform operations, as described below, in accordance with the control parameters and predetermined process flows, such as the example process flow described below with respect to FIG. 5. Scalefactor estimation controller 302 may communicate with quantization and encoding controller 202, described above, to receive control parameters and to report status. Further, scalefactor estimation controller 302 may communicate with and receive status updates from the respective modules of scalefactor estimation module 204 to allow scalefactor estimation controller 302 to control operation of the scalefactor estimation process. As described below with respect to equations [1] through [4], the scalefactor estimation process can be implemented in multiple stages, each stage relying upon an output generated by a previous stage. In FIG. 3 and FIG. 5, the scalefactor estimation process is described as a 4-stage process; however, different embodiments may implement the scalefactor estimation process with any number of stages consistent with the described approach, for example, by combining multiple stages into a single stage, or by splitting a single stage into multiple stages.

Spectrum difference generating module 304 can be invoked by scalefactor estimation controller 302 to perform a first stage of the scalefactor estimation process in which a distortion level, or difference $Diff_k$, for a selected scalefactor band spectrum value is determined based on a received maximum tolerant distortion threshold and a sum of the spectrum values in the scalefactor band. For example, an equation that may be implemented by spectrum difference generating module 304 to achieve such a result based on such input values is represented at equation [1] below.

$$Diff_k^2 = \text{Distortion}_{sfb} * |X(k)|^{\frac{1}{2}} \Big/ \sum_{k=1}^{n} |X(k)|^{\frac{1}{2}} \quad X(k) \neq 0 \qquad \text{[EQ. 1]}$$

A derivation and further explanation of equation [1] is provided with respect to the derivation of equation [24] below.

Temporary value generating module 306 can be invoked by scalefactor estimation controller 302 to initiate a second stage of the scalefactor estimation process by generating an interim process value based on the difference generated by the spectrum difference generating module 304, as described above, and based on the selected scalefactor band spectrum value for which the difference was obtained. For example, an equation that may be implemented by temporary value generating module 306 to achieve such a result based on such input values is represented at equation [2] below.

$$a = 3 * \left( \left( 1 + 0.5 * \frac{Diff_k}{|X(k)|} \right)^{\frac{1}{2}} - 1 \right) \qquad \text{[EQ. 2]}$$

A derivation and further explanation of equation [2] is provided with respect to the derivation of equation [17] below.

Spectrum value scalefactor generating module 308 can be invoked by scalefactor estimation controller 302 to complete the second stage of the scalefactor estimation process by generating a scalefactor for the selected scalefactor band spectrum value based on the interim process value generated by the temporary value generating module 306, as described above, and based on a predetermined fraction. In one embodiment, this predetermined fraction, for example, may be a common predetermined fraction associated with each of the scalefactor band spectrum values in a scalefactor band. In another embodiment, the predetermined fraction may be a value which has been statistically pre-determined based on the scalefactor band spectrum values themselves and/or can be a predetermined value associated with the scalefactor band by the AAC encoding profile being implemented. For example, an equation that may be implemented by spectrum value scalefactor generating module 308 to achieve such a result based on such input values is represented at equation [3] below.

$$Scf1 = |X(k)| * \left( \frac{a}{\text{fraction}} \right)^{\frac{4}{3}} \qquad \text{[EQ. 3]}$$

A derivation and further explanation of equation [3] is provided with respect to equation [16] below.

Spectrum band scalefactor generating module 310 can be invoked by scalefactor estimation controller 302 to perform a third stage of the scalefactor estimation process in which a scalefactor for a scalefactor band is generated based on the scalefactor generated by spectrum value scalefactor generating module 308 for the selected scalefactor band spectrum value. For example, an equation that may be implemented by spectrum band scalefactor generating module 310 to achieve such a result based on such an input value is represented at equation [4] below.

$$Scf = 4 * \log_2(Scf1) \qquad \text{[EQ. 4]}$$

A derivation and further explanation of equation [4] is provided with respect to the derivation of equation [7] below.

Figure 4:
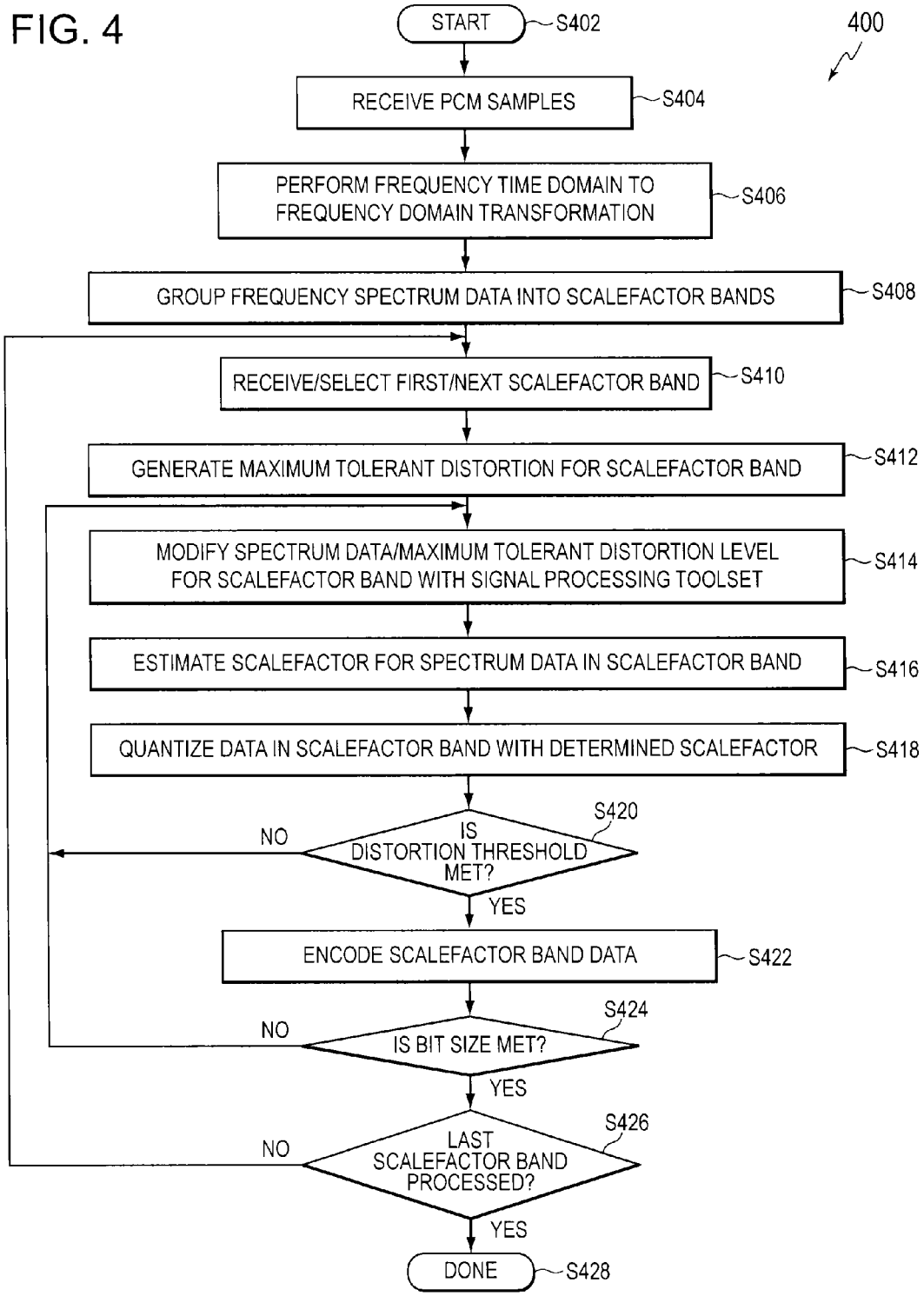
FIG. 4 is a flow-chart of an example quantization and encoding process that uses an example embodiment of the described scalefactor estimation approach.

FIG. 4 is a flow-chart of an example quantization and encoding process that may be implemented by audio signal encoder 100 with the support of quantization and encoding module 112 and scalefactor estimation module 204, as described above with respect to FIG. 1 through FIG. 3. As shown in FIG. 4, operation of process 400 begins at S402 and proceeds to S404.

At S404, frequency domain transformation module 102 receives digital, time-domain based, audio signal samples, e.g., pulse-code modulation samples, and operation of the process continues at S406.

At S406, frequency domain transformation module 102 performs a time-domain to frequency-domain transformation, e.g., a modified discrete cosine transform, on the received digital, time-domain based, audio signal samples that results in digital, frequency-based audio signal samples, or audio signal spectrum values, or spectrum values, and operation of the process continues at S408.

At S408, frequency domain transformation module 102 arranges the spectrum values into frequency bands, or scalefactor bands, that reflect the Bark scale of the human auditory system, and operation of the process continues at S410.

At S410, psychoacoustic module 104 receives/selects a first/next set of scalefactor band spectrum values from frequency domain transformation module 102, and operation of the process continues at S412.

At S412, psychoacoustic module 104 processes the set of scalefactor band spectrum values to eliminate inaudible data and to generate a maximum tolerant distortion threshold for the scalefactor band based on a psychoacoustic model of human hearing, and operation of the process continues at S414.

At S414, signal processing toolset module 110 can apply one or more signal processing techniques associated with a selected AAC encoding profile, e.g., the AAC low complexity profile, to support further compression of the scalefactor band spectrum values and/or to further refine the maximum tolerant distortion threshold for the scalefactor band, and operation of the process continues at S416.

At S416, scalefactor estimation module 204 can be invoked by quantization and encoding module 112 to generate an estimated scalefactor for the currently selected scalefactor band based on received scalefactor band spectrum values and the associated scalefactor band maximum tolerant distortion threshold, as described above with respect to FIG. 3, and operation of the process continues at S418.

At S418, quantization module 206 can be invoked by quantization and encoding module 112 to quantize the scalefactor band spectrum values associated with the currently selected scalefactor band based on the estimated scalefactor generated at S416, and operation of the process continues at S420.

At S420, distortion threshold constraint module 210 can be invoked by quantization and encoding module 112 to determine whether the quantized scalefactor band spectrum values have introduced a level of distortion that exceeds the maximum tolerant distortion threshold for the scalefactor band. For example, distortion threshold constraint module 210 may generate a difference between an inverse quantized spectrum value and a corresponding quantized spectrum value produced by quantization module 206 at S418, above, e.g., as described below with respect to equation [25] through [27]. If the maximum tolerant distortion threshold is met, operation of the process continues at S422; otherwise, operation of the process continues at S414.

At S422, encoding module 208 can be invoked by quantization and encoding module 112 to encode the quantized scalefactor band spectrum values generated by quantization module 206 at S418, and operation of the process continues at S424.

At S424, bit rate constraint module 212 can be invoked by quantization and encoding module 112 to determine whether the encoded, quantized scalefactor band spectrum values meet a bit rate constraint imposed on the scalefactor band by, for example, an external control parameter that reflects an end-user requirement, or a bit constraint imposed by one or more of the signal processing tools included in the encoding profile implemented by signal processing toolset module 110. If the bit constrain is met, operation of the process continues at S426; otherwise, operation of the process continues at S414.

At S426, if the last scalefactor band generated by frequency domain transformation module 102 at S408 has been quantized and encoded, operation of the process terminates at S428; otherwise, operation of the process continues at S410.

FIG. 5 is a flow-chart of an example scalefactor estimation process that may be implemented by scalefactor estimation module 204, as described above with respect to FIG. 3. As shown in FIG. 5, operation of process 500 begins at S502 and proceeds to S504.

At S504, scalefactor estimation controller 302 receives from quantization and encoding controller 202, scalefactor band spectrum values and a maximum tolerant distortion threshold for the scalefactor band, and operation of the process continues at S506.

At S506, scalefactor estimation controller 302 selects a scalefactor band spectrum value from the set of received scalefactor band spectrum values, and operation of the process continues at S508.

At S508, spectrum difference generating module 304 is invoked by scalefactor estimation controller 302 to perform a first stage of the scalefactor estimation process in which a distortion level, or difference, for the selected scalefactor band spectrum value is determined based on the received maximum tolerant distortion threshold and a sum of the spectrum values in the scalefactor band, as described above with respect to FIG. 3, and operation of the process continues at S510.

At S510, temporary value generating module 306 can be invoked by scalefactor estimation controller 302 to initiate a second stage of the scalefactor estimation process by generating an interim process value based on the difference generated at S508, and as described above with respect to FIG. 3, and operation of the process continues at S512.

At S512, spectrum value scalefactor generating module 308 is invoked by scalefactor estimation controller 302 to complete the second stage of the scalefactor estimation process by generating a scalefactor for the selected scalefactor band spectrum value based on the interim process value generated at S510, and as described above with respect to FIG. 3, and operation of the process continues at S514.

At S514, spectrum band scalefactor generating module 310 is invoked by scalefactor estimation controller 302 to perform a third stage of the scalefactor estimation process in which a scalefactor for the scalefactor band is generated based on the scalefactor generated for the selected scalefactor band spectrum value at S512, and as described above with respect to FIG. 3, and operation of the process terminates at S516.

The derivation of equations [1] through equation [4] described above with respect to FIG. 3 and FIG. 5 is described below with respect to equation [5] to equation [27]. The derivation of equations [1] through equation [4] are based on algorithms defined in advance audio coding (AAC) ISO/IEC 14496-3, which states that the quantization and inverse quantization formulas used by an AAC encoder can be simplified to equation [5] and equation [6], provided below.

$$X_{quant}(k) = sgn(X(k)) * \text{int}\left\{\left(|X(k)| * 2^{\frac{Scf}{4}}\right)^{\frac{3}{4}} + \text{Magic_Number}\right\} \quad \text{[EQ. 5]}$$

Where $X_{quant}(k)$ is the quantized spectrum; and, MAGIC_NUMBER=0.4054

$$X_{invquant}(k) = sgn(X_{quant}(k)) * |X_{quant}(k)|^{\frac{4}{3}} * 2^{\frac{Scf}{4}} \quad \text{[EQ. 6]}$$

Where $X_{invquant}(k)$ is the reconstructed spectrum.

To begin the derivation process, the scalefactor band spectrum values are limited to positive values, and the relationship between the scalefactor for a spectrum value within a scalefactor band and the scalefactor for the scalefactor band as a whole is assumed to be provided by equation [7] below.

$$Scf1 = 2^{\frac{Scf}{4}} \text{ which is equivalent to } Scf = 4 * \log_2(Scf1) \quad \text{[EQ. 7]}$$

Where Scf1 is the scalefactor for a selected spectrum value within the scalefactor band; and, Scf is the scalefactor for the scalefactor band as a whole In this case, equations [5] and [6] above may be rewritten as equations [8] and [9] below.

$$X_{quant}(k) = \text{int}\left\{(X(k)/Scf1)^{\frac{3}{4}} + \text{Magic_Number}\right\} \quad \text{[EQ. 8]}$$

$$X_{invquant}(k) = (X_{quant}(k))^{\frac{4}{3}} * Scf1 \quad \text{[EQ. 9]}$$

Because int(x+MAGIC_NUMBER)=x+fraction, equation [8] can be rewritten as is changed to $$X_{quant}(k) = (X(k)/Scf1)^{\frac{3}{4}} + \text{fraction} \quad \text{[EQ. 10]}$$

Further, by defining Diff as the difference between $X_{invquant}(k)$ and X(k), based on equation [8] and [9], Diff may be written in equation form as shown below in equation [11].

$$\text{Diff} = |X_{invquant}(k) - X(k)| = \left|(X_{quant}(k))^{\frac{4}{3}} * Scf1 - X(k)\right| = \left|\left((X(k)/Scf1)^{\frac{3}{4}} + \text{fraction}\right)^{\frac{4}{3}} * Scf1 - X(k)\right| \quad \text{[EQ. 11]}$$

Newton's generalized binomial theorem is presented at equation [12] below.

$$(a+1)^{\frac{4}{3}} = (a+1)*(a+1)^{\frac{1}{3}} = (a+1)*\left(1 + \frac{1}{3}a - \frac{1}{9}a^2 + \frac{5}{81}a^3 - \frac{10}{243}a^4 + \ldots\right) \quad \text{[EQ. 12]}$$

If |a|<1, the high exponent items can be truncated, and an approximation of equation [12] is $$(a+1)^{\frac{4}{3}} = 1 + \frac{4}{3}a + \frac{2}{9}a^2 \quad \text{[EQ. 13]}$$

Therefore, the Diff calculation in equation [11] can be transformed to $$\text{Diff} = X(k)*(1+a)^{\frac{4}{3}} - X(k) = X(k)*\left(\frac{4}{3}a + \frac{2}{9}a^2\right) \quad \text{[EQ. 14]}$$

Where a>0

$$\frac{2}{9}a^2 + \frac{4}{3}a - \frac{\text{Diff}}{X(k)} = 0 \quad \text{[EQ. 15]}$$

$$\text{Where } a = \text{fraction}*(Scf1/X(k))^{\frac{3}{4}} \quad \text{[EQ. 16]}$$

Since |fraction|<1, if a positive fraction is chosen and 0<Scf1/X(k)<1, 0<a<1 is fulfilled. Therefore, the positive root of equation [15] is $$a = 3*\left(\left(1 + 0.5*\frac{Diff}{X(k)}\right)^{\frac{1}{2}} - 1\right) \quad \text{[EQ. 17]}$$

Therefore, based on equation [17] if we know Diff for a spectrum value X(k), we can determine a based on equation [17], and further, we can determine a scalefactor for the spectrum value X(k) based on equation [16] by equation [7], $Scf1=2^{Scf/4}$.

From the description above with respect to equations [5]-[17] the mathematical relationship between Diff and a scalefactor for a spectrum value X(k) within a scalefactor band is described. Equations [18]-[24] describe how to determine the Diff for each spectrum value based on the scalefactor band maximum tolerant distortion threshold, $\text{Distortion}_{sfb}$. For example, for each scalefactor band, the following two constrains are always true:

1)

$$\text{Distortion}_{sfb} = \sum_{k=1}^{n} \text{Distortion}_k = \sum_{k=1}^{n} \text{Diff}_k^2 \quad \text{[EQ. 18]}$$

Where $\text{Distortion}_{sfb}$ is the scalefactor band maximum tolerant distortion threshold for the whole scalefactor band;

$\text{Distortion}_k$ is the distortion at each spectrum value X(k); and n is the number of spectrum values in the scalefactor band.

A second constraint assumes that for all spectrum values in a common scalefactor band, a single uniform scalefactor is used, as shown in equation [19] below

2)

$$Scf_1 = Scf_2 = \ldots = Scf_n \quad \text{[EQ. 19]}$$

Therefore, based on equation [19], i.e., constraint #2, and equation [7], i.e., $$Scf1 = 2^{\frac{Scf}{4}},$$

above, we have $Scf1_1=Scf1_2= \ldots =Scf1_n$, which states that the scalefactor for each scalefactor band value within a scalefactor band can be assumed to be the same.

Assuming that that the parameter fraction is the same value for all spectrum values and is chosen based on statistical analysis, as described above, equation [14] can be rewritten as $$\text{Diff}_k = X(k)*\frac{4}{3}*a = X(k)*\frac{4}{3}*\text{fraction}*(Scf1/X(k))^{\frac{3}{4}} = \frac{4}{3}\text{fraction}*Scf1^{\frac{3}{4}}*X(k)^{\frac{1}{4}} \quad \text{[EQ. 20]}$$

Assuming Coeff=4/3 fraction*$Scf1^{3/4}$, equation [20] can be rewritten as $$\text{Diff}_k = \text{coeff}*X(k)^{\frac{1}{4}} \quad \text{[EQ. 21]}$$

Where Coeff=4/3 fraction*$Scf1^{3/4}$, for all spectrum $\text{Coeff}_1=\text{Coeff}_2= \ldots =\text{Coeff}_n=\text{Coeff}$ According to equation [18], above, therefore, $$\text{Distortion}_{sfb} = \sum_{k=1}^{n} \text{Diff}_k^2,$$

therefore, $$\text{Distortion}_{sfb} = \sum_{k=1}^{n} \text{Diff}_k^2 = \sum_{k=1}^{n} \text{coeff}_k^2 * X(k)^{\frac{1}{2}} = \text{Coeff}^2 * \sum_{k=1}^{n} X(k)^{\frac{1}{2}} \quad \text{[EQ. 22]}$$

And hence, $$\text{Coeff}^2 = \text{Distortion}_{sfb} \Big/ \sum_{k=1}^{n} X(k)^{\frac{1}{2}} \quad \text{[EQ. 23]}$$

From equation [20] and equation [23], above, $$\text{Diff}_k^2 = \text{Coeff}^2 * X(k)^{\frac{1}{2}} = \text{Distortion}_{sfb} * X(k)^{\frac{1}{2}} \Big/ \sum_{k=1}^{n} X(k)^{\frac{1}{2}} \quad \text{[EQ. 24]}$$

Since the right side parameters for equation [24] are all known, if we chose a non-zero spectrum value X(k), $\text{Diff}_k$ can be calculated. By combining equation [24] with equation [17], [16], and [7], as described above with respect to equation [1] through equation [4], and the final scalefactor for the scalefactor band can be determined.

In the equations above, the spectrum values X(k) are assumed to be positive numbers. However, if the spectrum values X(k) are negative, equation [5] and [6] can be rewritten as equation [25] and equation [26], below.

$$X_{quant}(k) = -\text{int}\left\{(|X(k)|/Scf1)^{\frac{3}{4}} + \text{MAGIC_NUMBER}\right\} = -X'_{quant}(k) \quad \text{[EQ. 25]}$$

$$X_{invquant}(k) = -(|X_{quant}(k)|)^{\frac{4}{3}} * Scf1 = -(|X'_{quant}(k)|)^{\frac{4}{3}} * Scf1 = -X'_{invquant}(k) \quad \text{[EQ. 26]}$$

Where $X'_{quant}(k)$ is the quantization result for X'(k)=abs(X(k)), and $X'_{invquant}(k)$ is the inverse quantization result for X'(k)=abs(X(k)).

Based on equation [11] we know that Diff=$|X_{invquant}(k)-X(k)|$, therefore, $$\text{Diff} = |X_{invquant}(k) - X(k)| = |-X'_{invquant}(k) - (-X'(k))| = |X'_{invquant}(k) - X'(k)| \quad \text{[EQ. 27]}$$

and it follows the mathematic model is also suitable for all negative spectrum value X(k). Therefore, abs(X(k)) may be used to replace X(k) in all equations.

Figure 6:
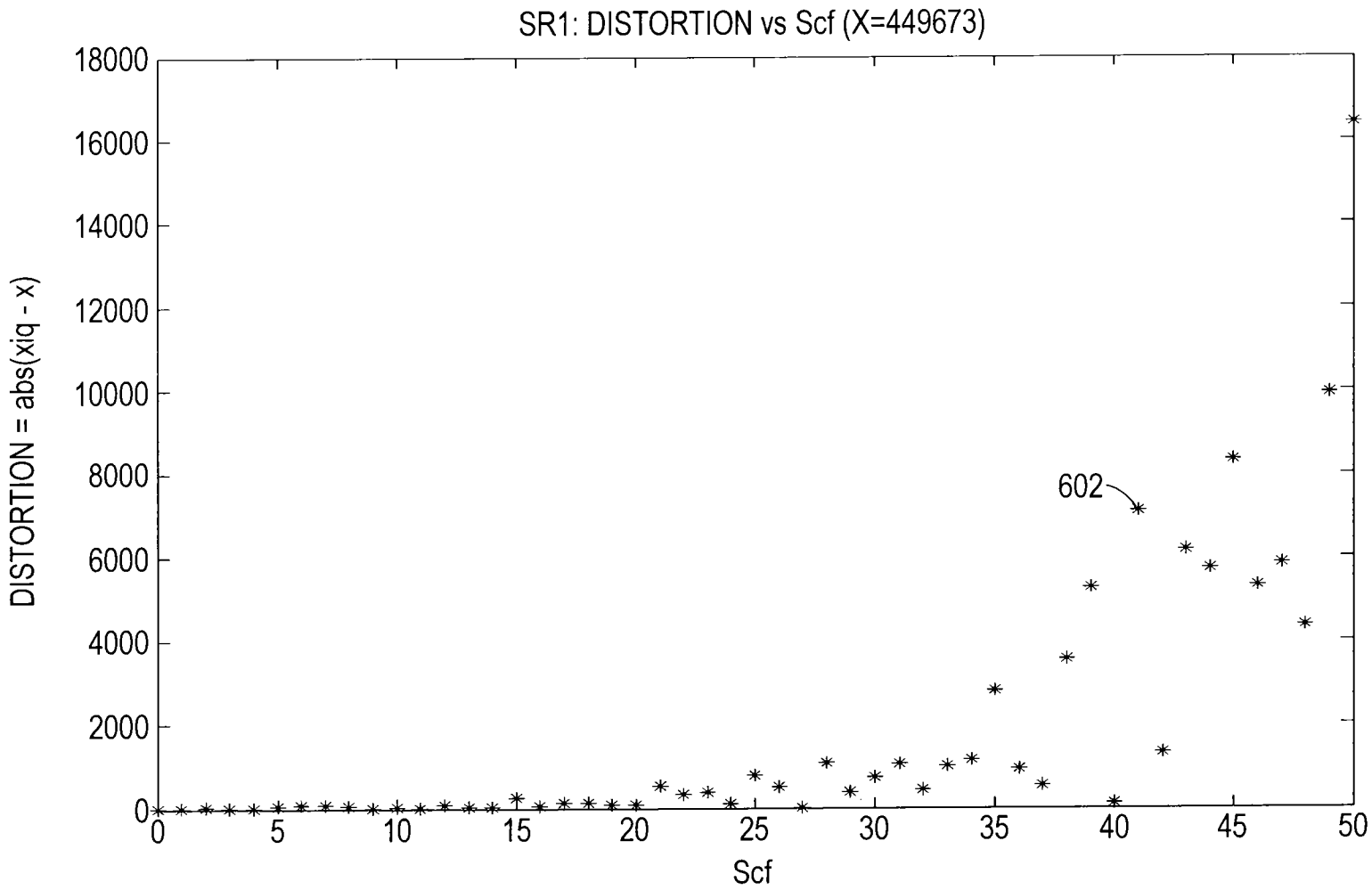
FIG. 6 is a plot of calculated real distortion levels introduced to a stream of encoded audio spectrum values as a result of quantizing the audio spectrum values with scalefactors selected from a set of linearly increasing scalefactors.

FIG. 6 is a plot of real distortion levels 602 introduced to a stream of encoded audio spectrum values as a result of quantizing the audio spectrum values with scalefactors selected from a set of linearly increasing scalefactors. As shown in FIG. 6, distortion levels (represented on the y-axis) in quantized data increases when larger scalefactors (represented on the x-axis) are used in the quantization process.

Figure 7:
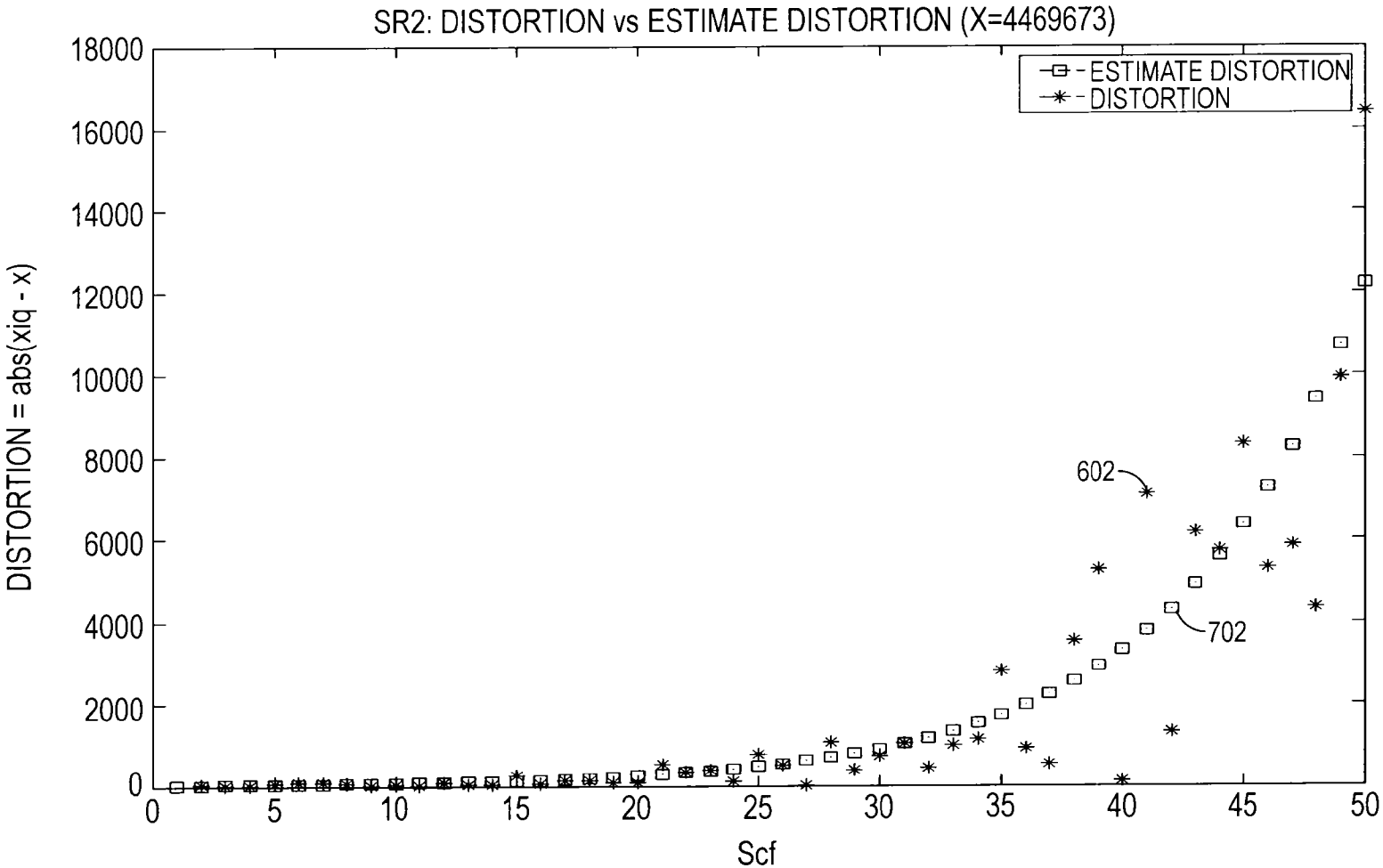
FIG. 7 is a plot of the calculated real distortion levels shown in FIG. 6, and a plot of estimated distortion levels determined using aspects of the described scalefactor estimation approach.

FIG. 7 is a plot of the real distortion levels 602 shown in FIG. 6, and a plot of estimated distortion levels 702 determined using aspects of the described scalefactor estimation approach. For example, the estimated distortion levels show at 702 may be estimated based on equation [14], described above.

Figure 8:
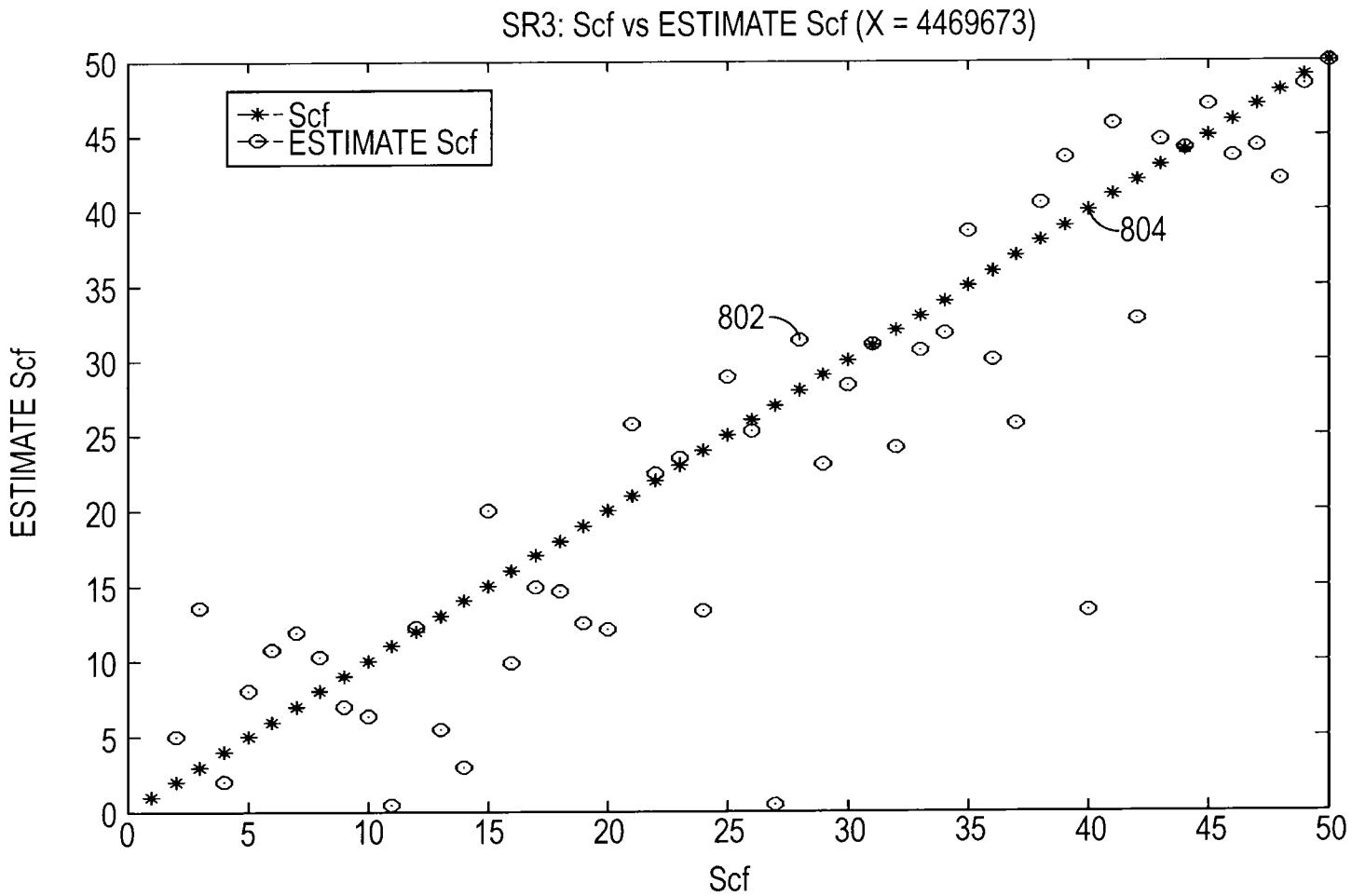
FIG. 8 is a plot of scalefactors estimated using aspects of the described scalefactor estimation approach based on real distortion levels calculated for audio spectrum values quantized using scalefactors selected from a set of linearly increasing scalefactors.

FIG. 8 is a plot of estimated scalefactors 802 (represented on the y-axis), estimated using aspects of the described scalefactor estimation approach based on distortion levels calculated for audio spectrum values quantized using scalefactors (represented on the x-axis) selected from a set of linearly increasing scalefactors 804. As demonstrated in FIG. 8, scalefactors can be effectively estimated from distortion levels, as described above with respect to equation [1] through equation [4].

Figure 9:
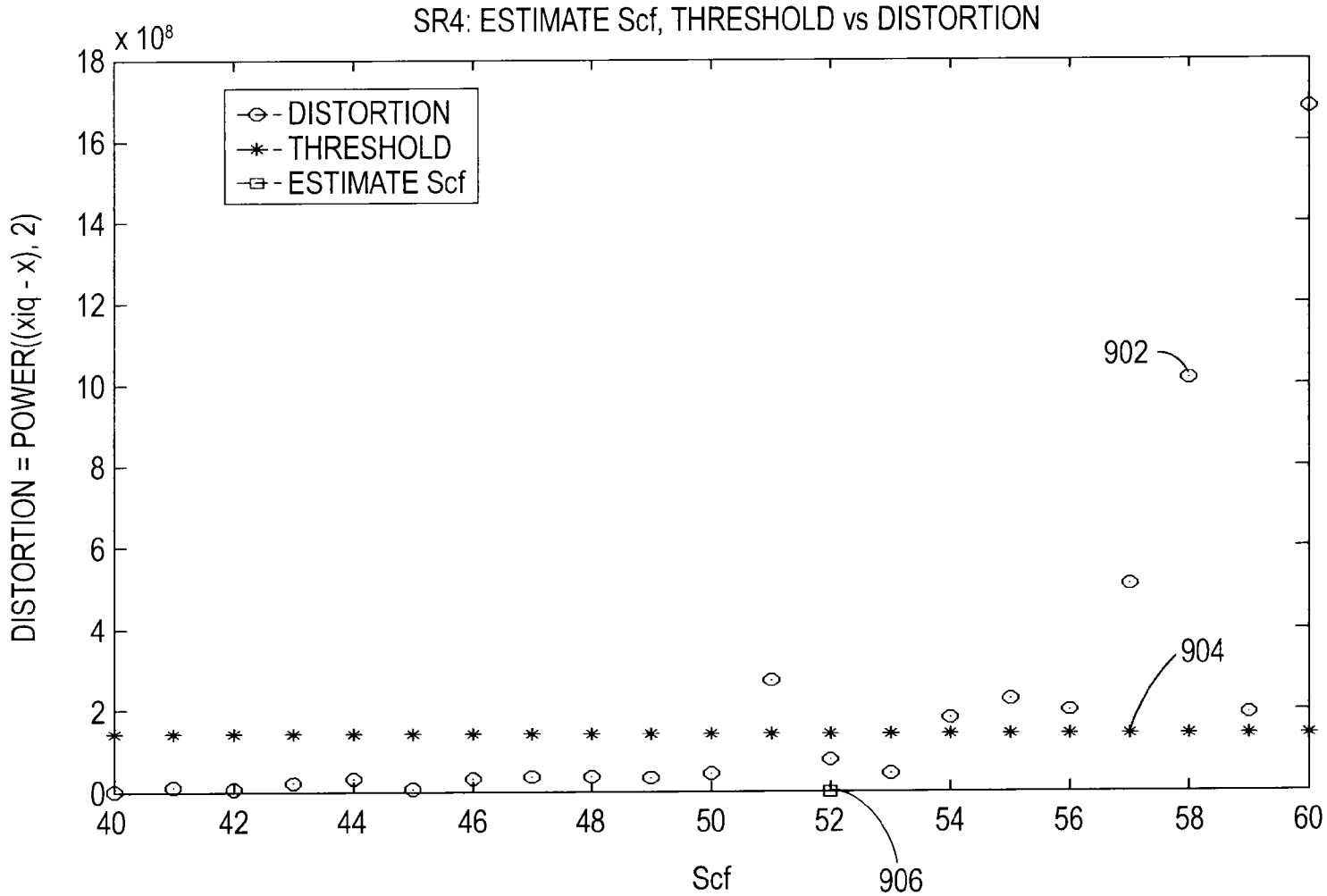
FIG. 9 includes a plot of calculated real distortion levels introduced to a stream of encoded audio spectrum values as a result of quantizing the audio spectrum values with a set of linearly increasing scalefactors, a plot of a target distortion threshold to be met by audio spectrum values quantized with an estimated scalefactor, and a plot of a scalefactor selected using the described scalefactor estimation approach.

FIG. 9 includes a plot of calculated real distortion levels 902 introduced to a stream of encoded audio spectrum values as a result of quantizing the audio spectrum values with a set of linearly increasing scalefactors, a plot of a target distortion threshold 904 to be met by audio spectrum values quantized with an estimated scalefactor, and a plot of an estimated scalefactor 906 determined using the described scalefactor estimation approach. As shown in FIG. 9, an estimated scalefactor, estimated using the described approach and shown in FIG. 9 as a single point at 906, will introduce a level of distortion to quantized data that is below the prescribed maximum tolerant distortion threshold 904.

It is noted that the scalefactor estimation approach, described above, can be used by a wide range of frequency-domain audio encoders, such as the advance audio coding (AAC) encoder and the MP3 encoder.

For purposes of explanation in the above description, numerous specific details are set forth in order to provide a thorough understanding of the described embodiments of an efficient approach for estimating scalefactors for use in the quantization of audio signal spectrum values. It will be apparent, however, to one skilled in the art based on the disclosure and teachings provided herein that the described embodiments may be practiced without these specific details. In other instances, well-known structures and devices are shown in block diagram form in order to avoid obscuring the features of the described embodiments.

While the embodiments of an efficient approach for estimating scalefactors for use in the quantization of audio signal spectrum values have been described in conjunction with the specific embodiments thereof, it is evident that many alternatives, modifications, and variations will be apparent to those skilled in the art. Accordingly, the described embodiments, as set forth herein, are intended to be illustrative, not limiting. There are changes that may be made without departing from the spirit and scope of the invention.

What is claimed is:

1. An audio encoder that includes a scalefactor estimation module, the scalefactor estimation module comprising:

a difference generating module that determines a distortion level for a spectrum value selected from a set of spectrum values in a scalefactor band, the distortion level based on a threshold for the scalefactor band, and the set of spectrum values within the scalefactor band, the distortion level being inversely proportional to a function of the set of spectrum values;

a spectrum value scalefactor generating module that generates a scalefactor for the selected spectrum value based in part on the determined distortion level and the selected spectrum value; and a spectrum band scalefactor generating module that generates a scalefactor for the scalefactor band based on the scalefactor generated for the selected spectrum value.

2. The audio encoder of claim 1, wherein the function of the set of spectrum values is a sum of the set of spectrum values.

3. The audio encoder of claim 1, wherein the function of the set of spectrum values is a weighted sum of the set of spectrum values.

4. The audio encoder of claim 1, wherein the threshold is indicative of a maximum distortion level that can be introduced to the spectrum values in the scalefactor band without substantially degrading quality of a quantized signal.

5. The audio encoder of claim 1, wherein the spectrum value scalefactor generating module generates the scalefactor for the selected spectrum value further based on a predetermined fraction.

6. The audio encoder of claim 5, wherein the predetermined fraction is based on a statistical analysis of the set of spectrum values in the scalefactor band.

7. The audio encoder of claim 1, wherein the difference generating module determines the distortion level based on the relationship $$\mathrm{Diff}_k^2 = \mathrm{Distortion}_{sfb} * |X(k)|^{\frac{1}{2}} \Big/ \sum_{k=1}^{n} |X(k)|^{\frac{1}{2}}$$

$$X(k) \neq 0,$$

wherein $\mathrm{Diff}_k$ is the distortion level at the selected spectrum value, wherein $\mathrm{Distortion}_{sfb}$ is the threshold, wherein X(k) is a spectrum value within the set of spectrum values, and wherein n is a number of spectrum values in the set of spectrum values.

8. The audio encoder of claim 1, wherein the spectrum value scalefactor generating module generates the scalefactor for the selected spectrum value based on the relationship $$Scf1 = |X(k)| * \left(\frac{a}{\text{fraction}}\right)^{\frac{4}{3}}$$

wherein Scf1 is the scalefactor for the selected spectrum value, wherein X(k) is the selected spectrum value, wherein $$a = 3 * \left(\left(1 + 0.5 * \frac{Diff_k}{|X(k)|}\right)^{\frac{1}{2}} - 1\right),$$

wherein fraction is the predetermined fraction, and wherein $\mathrm{Diff}_k$ is the distortion level at the selected spectrum value.

9. The audio encoder of claim 1, wherein the spectrum band scalefactor generating module generates the scalefactor for the scalefactor band based on the relationship $Scf=4*\log_2(Scf1)$, wherein Scf is the scalefactor for the scalefactor band and Scf1 is the scalefactor generated for the selected spectrum value.

10. The audio encoder of claim 1, further comprising:

a quantization module that quantizes the set of spectrum values within the scalefactor band based on the scalefactor generated for the scalefactor band.

11. A method of generating a scalefactor for a scalefactor band, the method comprising:

generating, by an encoder, a distortion level for a spectrum value selected from a set of spectrum values in the scalefactor band, the distortion level based on a threshold for the scalefactor band, and the set of spectrum values within the scalefactor band, the distortion level being inversely proportional to a function of the set of spectrum values;

generating a scalefactor for the selected spectrum value based in part on the distortion level and the selected spectrum value; and generating the scalefactor for the scalefactor band based on the scalefactor generated for the selected spectrum value.

12. The method of claim 11, wherein the function of the set of spectrum values comprises summing the set of spectrum values.

13. The method of claim 11, wherein the function of the set of spectrum values comprises weighting the set of spectrum values and summing the weighted set of spectrum values.

14. The method of claim 11, wherein generating the distortion level is based on the threshold being indicative of a maximum distortion level that can be introduced to the spectrum values in the scalefactor band without substantially degrading quality of a quantized signal.

15. The method of claim 11, wherein generating the scalefactor for the selected spectrum value is further based on a predetermined fraction.

16. The method of claim 15, wherein the predetermined fraction is based on a statistical analysis of the set of spectrum values in the scalefactor band.

17. The method of claim 11, wherein the distortion level is generated based on the relationship $$\mathrm{Diff}_k^2 = \mathrm{Distortion}_{sfb} * |X(k)|^{\frac{1}{2}} \Big/ \sum_{k=1}^{n} |X(k)|^{\frac{1}{2}}$$

$$X(k) \neq 0,$$

wherein $\mathrm{Diff}_k$ is the distortion level at the selected spectrum value, wherein $\mathrm{Distortion}_{sfb}$ is the threshold, wherein X(k) is a spectrum value within the set of spectrum values, and wherein n is a number of spectrum values in the set of spectrum values.

18. The method of claim 11, wherein the scalefactor for the selected spectrum value is generated based on the relationship $$Scf1 = |X(k)| * \left(\frac{a}{\text{fraction}}\right)^{\frac{4}{3}}$$

wherein Scf1 is the scalefactor for the selected spectrum value, wherein X(k) is the selected spectrum value, wherein $$a = 3 * \left( \left( 1 + 0.5 * \frac{Diff_k}{|X(k)|} \right)^{\frac{1}{2}} - 1 \right),$$

wherein fraction is the predetermined fraction, and wherein $Diff_k$ is the distortion level at the selected spectrum value.

19. The method of claim 11, wherein the scalefactor for the scalefactor band is generated based on the relationship $Scf=4*\log_2(Scf1)$, wherein Scf is the scalefactor for the scalefactor band and Scf1 is the scalefactor generated for the selected spectrum value.

20. The method of claim 11, further comprising:

quantizing the set of spectrum values within the scalefactor band based on the scalefactor generated for the scalefactor band to produce quantized spectrum values; and encoding the quantized spectrum values.

* * * * *